United States Patent [19]

Beale et al.

[11] Patent Number: 4,693,339

[45] Date of Patent: Sep. 15, 1987

[54] MUFFLER FOR GAS INDUCTING MACHINERY GENERATING LOW FREQUENCY NOISE

[75] Inventors: Michael C. Beale, Franklin; David H. Kashy, Hampton, both of Va.

[73] Assignee: Newport News Shipbuilding and Dry Dock Company, Newport News, Va.

[21] Appl. No.: 919,439

[22] Filed: Oct. 16, 1986

[51] Int. Cl.[4] ..... F01N 1/08

[52] U.S. Cl. ..... 181/255; 181/229; 181/280

[58] Field of Search ..... 181/229, 230, 237, 239, 181/253, 255, 279, 280

[56] References Cited

U.S. PATENT DOCUMENTS

| | | | |
|---|---|---|---|
| 1,578,682 | 3/1926 | Raymond . | |
| 1,598,521 | 8/1926 | Hazeltine | 181/253 |
| 2,646,854 | 7/1953 | Walker | 181/280 |
| 2,828,189 | 3/1958 | Houdry | 181/258 X |
| 3,140,043 | 7/1964 | Marcy . | |
| 3,270,834 | 9/1966 | Bratt . | |
| 3,689,197 | 9/1972 | Berle et al. | 417/18 |
| 3,710,889 | 1/1973 | Lamy . | |
| 3,718,410 | 2/1973 | Berger et al. | 418/15 |
| 3,829,237 | 8/1974 | Chestnutt | 415/181 |
| 3,918,530 | 11/1975 | Nyholm | 173/1 |
| 3,989,415 | 11/1976 | Van-Hee et al. | 417/312 |
| 4,005,572 | 2/1977 | Giffhorn . | |
| 4,025,291 | 5/1977 | Black | 431/346 |
| 4,050,539 | 9/1977 | Kashiwara et al. | 181/280 |
| 4,161,996 | 7/1979 | Dolejsi | 181/230 |
| 4,327,815 | 5/1982 | Hattori | 181/225 |
| 4,501,341 | 2/1985 | Jones | 181/250 |

*Primary Examiner*—Benjamin R. Fuller
*Attorney, Agent, or Firm*—Lalos & Keegan

[57] ABSTRACT

A muffler for silencing low frequency noise of gas inducting machinery. The muffler includes a buffer reservoir having an inlet and an outlet. The outlet communicates with the gas inlet of the machine. The buffer reservoir has a volume of between twenty and thirty times the displacement of the largest equivalent cylinder of the gas inducting machinery. For a single piston compressor this would be a volume of ten to fifteen times the effective cylinder displacement of the compressor. A convergent/divergent nozzle is connected to the reservoir inlet. The nozzle throat is specially dimensioned relative to the machinery to pass the gas through it to the gas inlet at a throat velocity in the range of Mach 0.7 to 1. A suitable preswirler may be connected to the inlet of the nozzle to reduce the pressure drop across the nozzle.

35 Claims, 11 Drawing Figures

MUFFLER FOR GAS INDUCTING MACHINERY GENERATING LOW FREQUENCY NOISE

The Government has rights in this invention pursuant to contract N00024-70-C-0238 awarded by the Department of the Navy.

BACKGROUND OF THE INVENTION

The present invention relates to mufflrs or silencers for silencing the noise of gas inducting machinery which generate low frequency noise and have unsteady intake flow. Such machinery includes air compressors, diesel engines and othr types of gas inducting machinery.

Silencers are known for suppressing the low frequency inlet noise from such gas inducting machinery as air compressors and the like. However, these prior art mufflers generally are of the absorptive or reactive type or combinations of these. For low frequency noise, both types of mufflers generally become quite bulky.

Because of the low frequencies involved for the subject machinery of about ten to twenty Hz for the primary pulse frequency, reactive or dissipative mufflers of reasonable size, which can effectively reduce noise levels, have not been developed. One known silencer is the Atlas Copco venturi silencer, which is described in their Bulletin AHB 7676, but it is very large—with an estimated volume of about 14.5 cubic feet. It also achieves noise reduction of the fundamental frequency of only eight to ten decibels. This silencer basically is a Helmholtz resonator (as described for example in U.S. Pat. No. 4,501,341) which has been modified by the use of a venturi for the throat section of the resonator instead of the normally used straight section pipe. The use of the venturi lowers the resonant frequency of the system and increases the insertion loss of the muffler. Even though the smaller throat diameter may result in a greater silencing effect, it appears that the designers consider high throat velocities undesirable because of the resulting increased pressure drop.

OBJECTS OF THE INVENTION

Accordingly, it is the principal object of the present invention to provide an improved muffler or silencer for gas inducting machinery, such as air compressors and the like.

Another object of the present invention is to provide an improved muffler for gas inducting machinery generating low frequency noise.

A further object of the present invention is to provide an improved gas inducting machinery muffler that is of small size.

A still further object of the present invention is to provide an improved muffler which achieves noise reductions greater than ten decibels and preferably greater than twenty-five decibels.

Another object of the present invention is to provide an improved muffler which results in only minimal pressure losses for the gas inducting machinery.

A further object is to provide a novel muffler which results in a decrease of efficiency of ten percent or less of the gas inducting machinery.

A still further object is to provide a muffler for machinery that inducts air or gas from the atmosphere and has a problem with low frequency inlet noise.

Another object is to provide a muffler which is inexpensive to construct and contains no moving parts which are prone to wear and jam and can themselves be the source of undesirable noise.

Other objects and advantages of the present invention will become more apparent to those persons having ordinary skill in the art to which the present invention pertains from the foregoing description taken in conjunction with the accompanying drawings.

DETAILED DESCRIPTION OF THE INVENTION

Figures 1, 2:
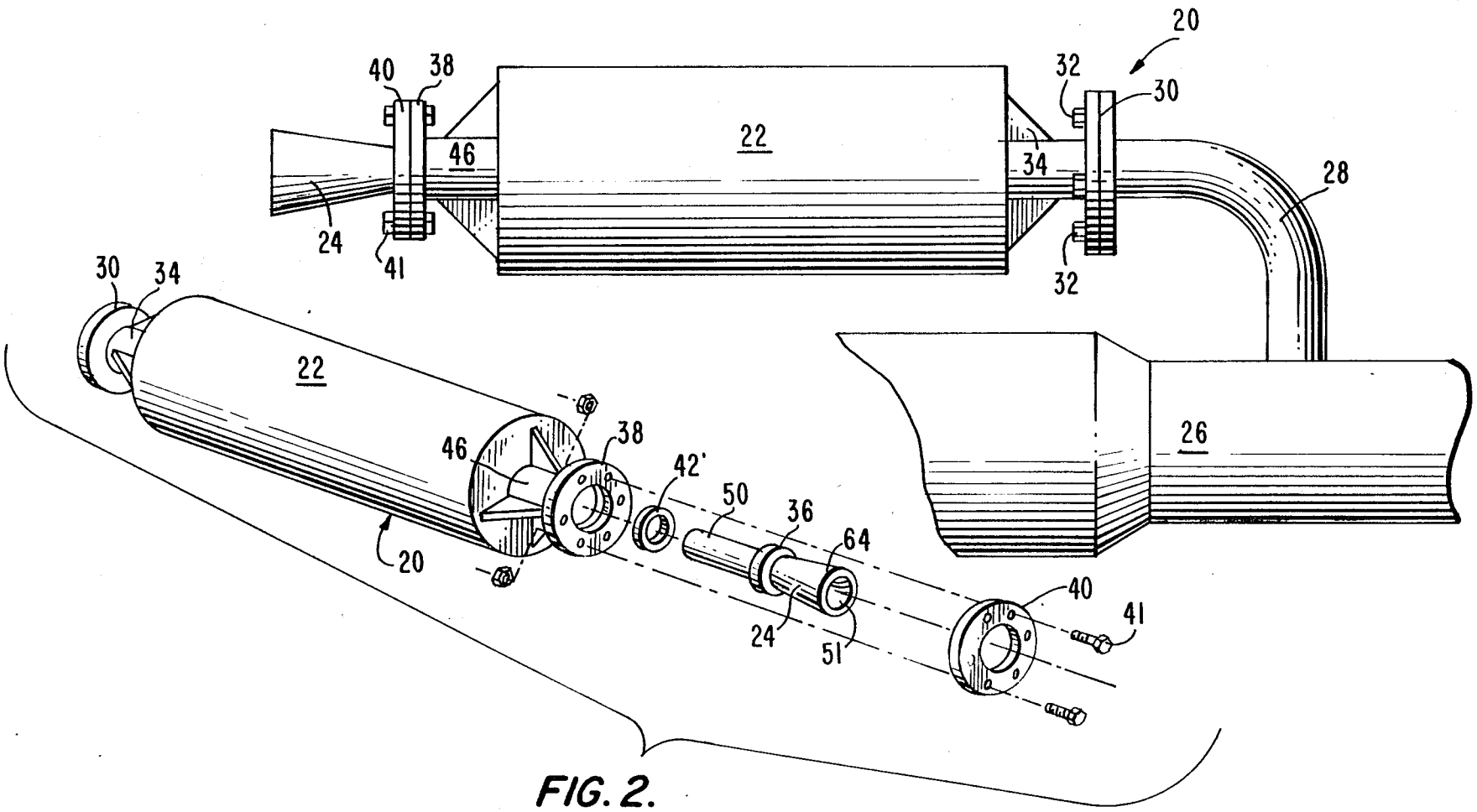
FIG. 1 is an elevational view of a muffler of the present invention shown operably connected to gas inducting machinery.
FIG. 2 is a perspective view of the muffler of FIG. 1 illustrating the components thereof in exploded relation.

Referring to FIG. 1 it is seen that the silencer or muffler of the present invention shown generally at 20 comprises basically two components: a buffer volume or reservoir shown generally at 22 and a convergent/divergent nozzle shown generally at 24. the buffer volume 22 may be of any shape and is shown in the drawings as cylindrical. Buffer reservoir 22 is secured to the gas inducting machinery 27 at its inlet pipe end 28. Muffler 20 is designed for machinery 26 which generates low frequency noise below twenty hertz, and which is characterized by very unsteady inlet flow. It is secured via a bolting flange 30 and a plurality of circularly spaced bolts 32, as illustrated in FIG. 1, but any suitable connecting means can be used. The outlet pipe 34 of buffer reservoir 22 thereby communicates directly with the inlet pipe 28 of the gas inducting machinery 26.

Figure 3:
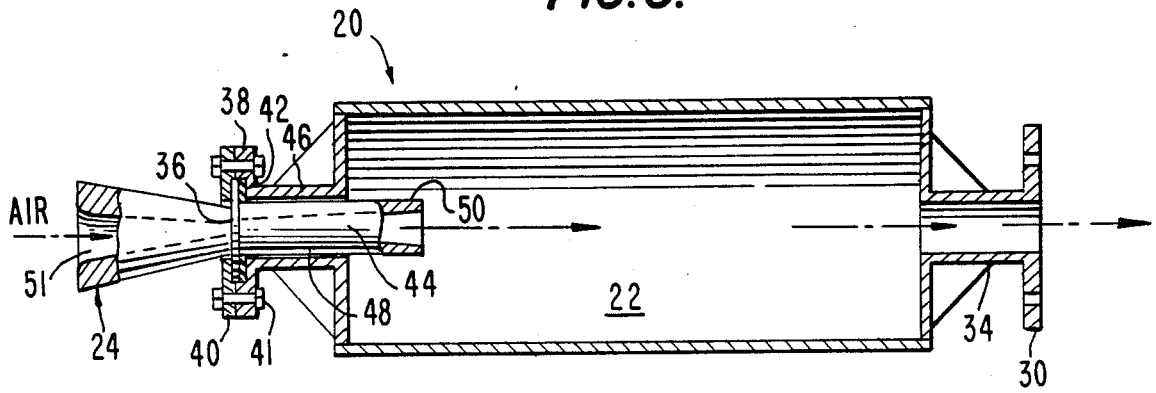
FIG. 3 is a side sectional view of the muffler of FIG. 1.
Figure 4:
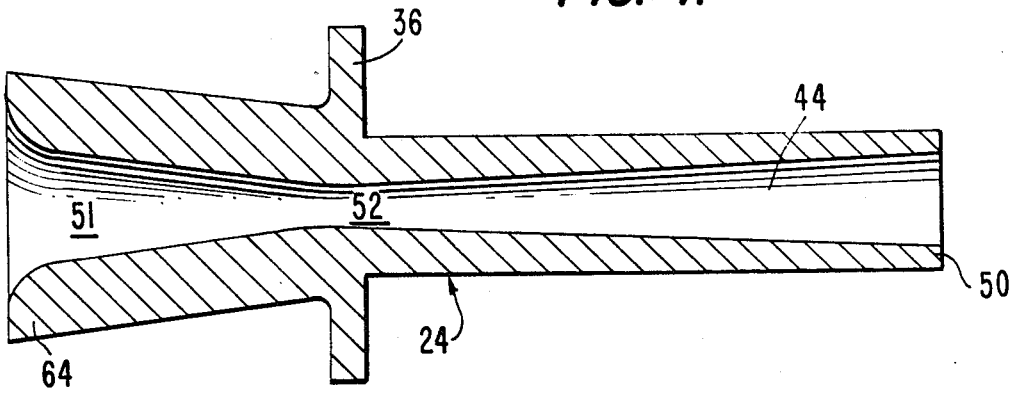
FIG. 4 is an enlarged sectional view of the nozzle of the muffler of FIG. 1.
Figure 5:
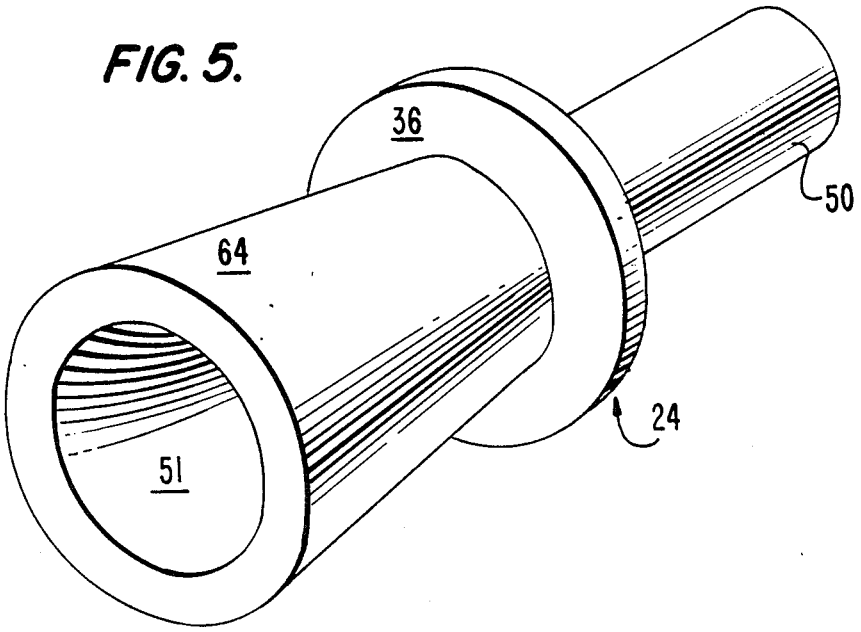
FIG. 5 is a perspective view of the nozzle of FIG. 1.

As illustrated in FIGS. 4 and 5, convergent/divergent nozzle 24 includes an integral centrally positioned annular shoulder 36. As best shown in FIGS. 2 and 3, shoulder 36 fits between the mounting flange 38 of the inlet of buffer reservoir 22 and the mounting adapter ring 40. Ring 40 is bolted via bolts 41 to mounting flange 38 and a suitable sealing ring or gasket 42 disposed between shoulder 36 and mounting flange 38 to provide an airtight seal, as illustrated in FIGS. 2 and 3.

When assembled as shown in FIG. 3, the divergent portion 44 of the nozzle is disposed within the inlet sleeve 46 of buffer reservoir 22 with a slight spacing 48 being dimensioned between them. Spacing 48 allows the nozzle to fit without sticking and eliminates the possibility of the pieces contacting during vibration and causing noise. The outlet end 50 of nozzle may extend a short distance into buffer reservoir 22, as illustrated.

Convergent/divergent nozzle 24 is configured to have smooth surfaces and gradual tapers to minimize the pressure drop across the nozzle. The throat section of the nozzle, or the narrowest portion of the air flow channel 51, is illustrated at 52 in FIG. 4. Throat 52 is very specially dimensioned for the specific gas inducting machinery 26 to which muffler 20 is to be attached. In particular,it is dimensioned so that the flow through the throat is choked, a phenomenon well known in the art. At this point the velocity of the flow is equal to the speed of sound and is said to be sonic.

Thus, in the nozzle of the subject invention when the flow is sonic, no sound can pass through the throat from the machinery intake to the outside. This principle is well known, and in fact is used experimentally in quieting inlet noise from aircraft gas turbine engines. In a typical example, where an air compressor has an intake flow of 500 cubic feet per minute, calculations by methods well known in the art yield a radius of throat 52 of 0.7612 inches to produce a throat speed of Mach. 1.

Further, divergent portion 44 of channel 51 diverges at an included angle between three and eight degrees with a slope of four and one half to five degrees being optimal. The discharge diameter of nozzle outlet end 50 should be large enough to recover pressure so that it is near the intake pressure of the machine 26. The discharge diameter should generally be between one and a half and five times the throat diameter, preferably about two and one half times the throat diameter.

In practice, it may be necessary or desirable to operate with a throat speed somewhat less than Mach. 1. In fact, there is an advantage in operating below the nozzle choke point in that the overall pressure recovery is better. The effect on noise suppression of operating slightly below Mach 1 is minimal, and in fact, the nozzle may be operated with a throat Mach number as low as Mach 0.7. At this point, noise suppression will not be maximal, but will still be appreciable and, in certain situations, may be perfectly acceptable. In the previous example, a throat radius of 0.796 inches will result in a throat speed of Mach 0.7. In sum, the subject inventio may be used to operate efficaciously in the range of Mach 1 to Mach 0.7 throat flow speed.

Buffer reservoir 22 is provided to keep the downstream pressure which nozzle 24 "sees" fairly constant. Without buffer reservoir 22, the flow through the nozzle 24 would be ver unsteady. Nozzle 24 wuld be choked during part of the intake cycle and unchoked at other times. The buffer reservoir 22 absorbs the fluctuations in pressure of the gas inducting machinery so that the velocity of flow through the nozzle is constant at the desired Mach number.

Buffer reservoir 22 is also carefull dimensioned for the specific machinery 26 to which muffler 20 is attached. For a piston compressor type of gas inducting machinery 26 having at least one intake cylinder, testing and calculations showed that the size of reservoir 22 should be ten to fifteen times the effective intake cylinder displacement. From a practical standpoint, once buffer reservoir 22 is larger than fifteen times the cylinder displacement, there is no further increase in muffler performance. Where the piston compressor has an intake flow in cubic feet per minute and a working rate in revolutions per minute, the effective displacement is defined in cubic feet by the intake flow divided by the working rate times the number of intake cylinders of the piston compressor. As an example, assume a one-cylinder compressor with intake flow of 500 $ft^3$/min and a working rate of 600 rpm. The effective displacement is $500/600(1)=0.833$ $ft^3$. The volume of buffer reservoir 22 should then be generally between $10\times0.833=8.33$ cubic feet and $15\times0.833=12.5$ cubic feet.

For gas-inducting machines other than the piston/-cylinder type, the size of the buffer reservoir can be calculated by first performing a Fourier analysis of the actual or calculated unsteady intake flow by methods known in the art. The displacements of the equivalent cylinders associated with the oscillatory components are calculated as $a_n$ divided by $\pi f_n$ where $a_n$ is the magnitude of the component of the unsteady flow in cubic feet per second and $f_n$ is the frequency of the component in hertz. Calculations show that the buffer volume should be twenty to thirty times the displacement of the largest equivalent cylinder. For example, the Fourier analysis of an air compressor showed that the first component ($n=1$) had the largest equivalent cylinder displacement, in this case 0.03652 cubic feet. The buffer reservoir for this compressor should have a volume of 20 $(0.03652)=0.73$ to 30 $(0.03652)=1.1$. cubic feet.

Figure 11:
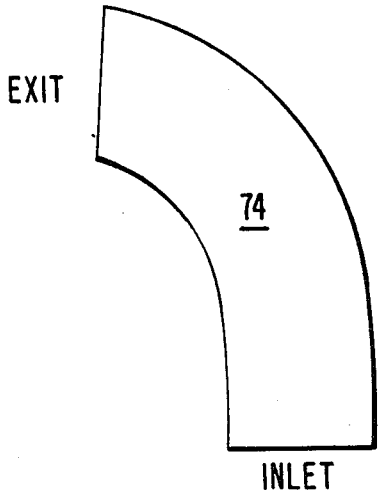
FIG. 11 is a flattened out view of a fin of the preswirler of FIG. 8 shown in isolation.
Figure 9:
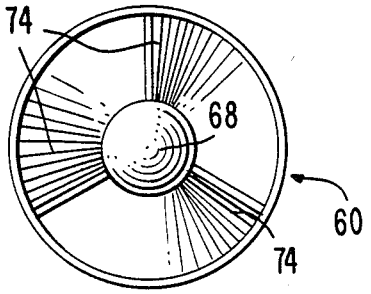
FIG. 9 is an end view of the preswirler of FIG. 8.
Figure 8:
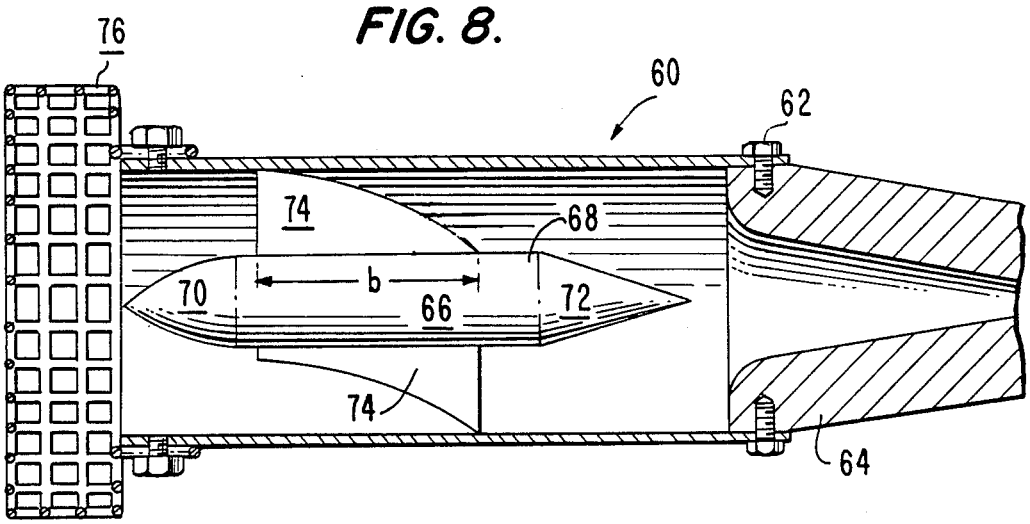
FIG. 8 is a cross-sectional view of a second preswirler of the present invention further illustrating an optional trash exclusion screen.
Figure 10:
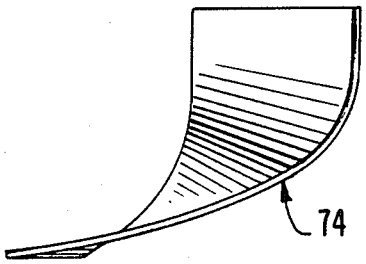
FIG. 10 is a view of one of the fins of the preswirler of FIG. 8 illustrated in isolation.

It is also within the scope of the present invention to secure a preswirler or swirling device to the inlet of nozzle 24. The swirler retards the separation of the flow in the diffuser sectoin of the nozzle which reduces the pressure drop across the nozzle and in turn results in greater mass flow. It also allows for a somewhat larger nozzle discharge angle so that the length of the nozzle can be reduced. By swirling the flow through the nozzle, the thickness of the boundary layer is reduced which increases the cross-sectional area of the throat through which the air (or other gas) can flow. One example is the axial flow preswirler 60 illustrated in FIG. 8. As shown, it is secured by screws 62 or other suitable fastenings at end 64 of the nozzle. Preswirler 60, as illustrated, comprises a core 66 incuding a cylinder 68 having outwardly projecting cones 70, 72 at each end. Three fins 74 are attached to core 66 and are configured as shown in isolation in FIG. 10 and are positioned one hundred and twenty degrees apart from each other, as best shown in FIG. 9. The preswirler may be characterized by the turning angle of the fin 74, that is, the angle through which the fin turns the gas flow. For practical purposes,this is the same as the angle between a line tangent to the curve of the fin 74 at its intersection with core 66 at the exit and the axis of the core cylinder 68. This fin angle may be anywhere from 10 to 75 degrees; in a test of three fin angles of 30°, 45° and 60°, 45° proved to be optimal. The length of the preswirler is determined by the fin angle; in the examples mentioned where fin angles were 30°, 45° and 60°, the lengths of the lines of intersection of fin 74 with core 66 as measured along the core axis, show as length b, were 4,104, 2.655 and 1.905 inches, respectively. FIG. 11 shows the 45° fin in its flat condition before being wrapped around the core 66. The intersection of the fin 74 with the core 66 when the core is unwrapped defines a circular arc. It is also within the scope of the present invention to include a screen 76 at the inlet of preswirler 60 as shown in FIG. 8 for excluding foreign objects. Where the preswirler device is not used, screen 76 can be attached directly to the intake end 64 of the nozzle.

Figure 6:
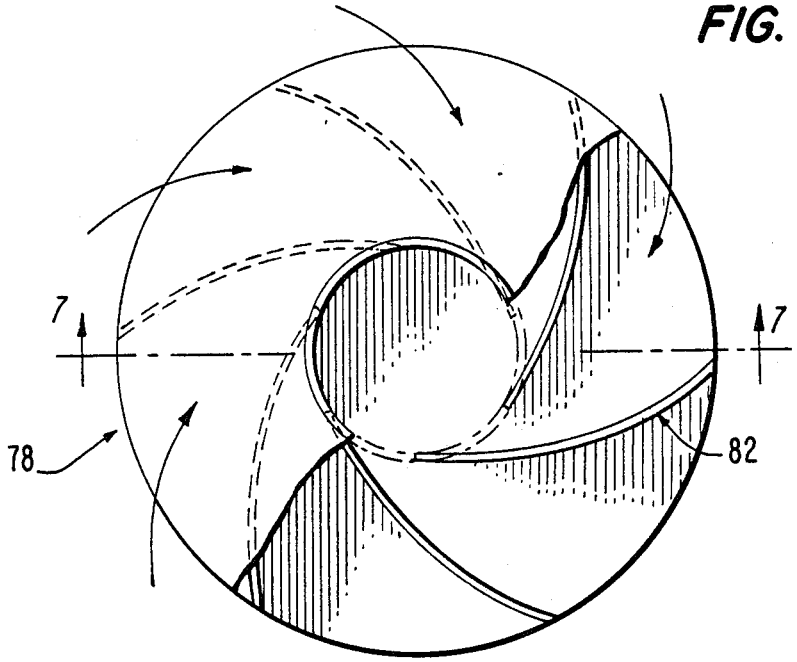
FIG. 6 is an end view of a swirling device which can be connected to the nozzle of FIG. 1.
Figure 7:
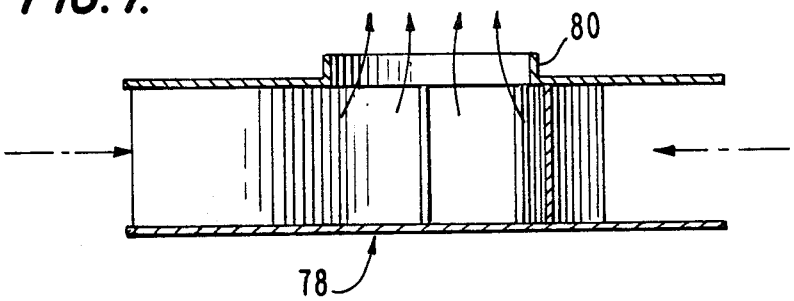
FIG. 7 is a cross-sectional view taken along line 7—7 of FIG. 6.

An alternative design for the preswirler is the radial flow preswirler as illustrated generally at 78 in FIGS. 6 and 7. The air enters preswirler 78 radially to the flow through nozzle 24 and exits axially through sleeve 80 in a swirling path due to fins 82 into the nozzle.

Experimental tests have shown that this muffler when operating with an average throat Mach number of 0.8 is able to reduce the intake noise of an air compredssor by twenty-five to thirty decibels. In contrast, NASA publications indicate that at a throat Mach number of 0.8 the noise reduction wuld be on the order of only six decibels. As a practical matter in a typical situation insertion losses greater than forty decibels would not be needed because other sources of noise from the compressor would determine the overall noise level. This noise reduction was achieved with only a five to ten percent decrease in the efficiency of the compressor. More particularly with a throat speed of Mach 0.7 nearly 95% of the design mass flow passed into the compressor. This slight loss in efficiency is acceptable given the significant noise reduction attained and the small muffler size, which for present muffler 20 may be as small as one cubic foot. In contrast to the Atlas Copco "linear acoustic" silencer the subject silencer or muffler 20 operates by a completely different method. It relies on the nonlinear mass flow versus pressure differential characteristics of a nozzle operating at high throat velocities, that is, as close to Mach 1 as practical. Under these conditions, the nonlinear effects of the nozzle provide very high noise reduction using a very small muffler.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention can be considered as within the scope thereof as limited solely by the appended claims.

We claim:

1. For gas inducting machinery having a determinable displacement of the largest equivalent cylinder and a gas inlet, a muffler comprising:

a buffer reservoir having an inlet and an outlet, said outlet being communicable with the gas inlet, said buffer reservoir having a volume of between twenty and thirty times the displacement of the largest equivalent cylinder of the gas inducting machinery, a convergent/divergent nozzle connected to said reservoir inlet, said nozzle including a throat through which the gas passes into said buffer reservoir, and said throat being dimensioned relative to said machinery to obtain a gas flow speed in said throat of at least Mach 0.7.

2. The muffler of claim 1 including, said displacement of the equivalent cylinder being equal to $a_n/\pi f_n$, where $a_n$ is the magnitude of the $n^{th}$ component of the unsteady intake flow in feet$^3$/sec, and where $f_n$ is the frequency of the $n^{th}$ component in hertz.

3. The muffler of claim 1 including:

said gas velocity being in the range of Mach 0.7 to Mach 1.

4. The muffler of claim 1 including, said nozzle having a nozzle inlet opening, and a channel having a divergent portion with an included angle of between 3° and 8°.

5. The muffler of claim 1 including, said buffer reservoir having a reservoir end connectable to said gas inlet and being adapted for use with said machinery generating flow frequency noise below 20 hertz and unsteady inlet flow.

6. The muffler of claim 1 including, said nozzle having a discharge diameter 1.5 to 5 times greater than the diameter of said throat and said buffer reservoir being cylindrically shaped and having its longitudinal axis extending between said gas inlet and said throat.

7. The muffler of claim 1 including, said nozzle having one end positioned inside of said buffer reservoir and its opposite end positioned outside of said buffer reservoir.

8. The muffler of claim 1 including, said gas velocity being in the range of Mach 0.7 to Mach 1, said nozzle having a nozzle inlet opening and a channel having a divergent portion with an included angle of between 3° and 8°, and said buffer reservoir having a reservoir end connectable to said gas inlet and being adapted for use with said machinery generating low frequency noise below 20 hertz and unsteady inlet flow.

9. The muffler of claim 1 including, said displacement of the equivalent cylinder being equal to $a_n/\pi f_n$, where $a_n$ is the magnitude of the $n^{th}$ component of the unsteady intake flow in feet$^3$/sec, and where $f_n$ is the frequency of the $n^{th}$ component in hertz, and said gas velocity being in the range of Mach 0.7 to Mach 1.

10. The muffler of claim 9 including, said displacement of the equivalent cylinder being equal to $a_n/\pi f_n$, where $a_n$ is the magnitude of the $n^{th}$ component of the unsteady flow in feet$^3$/sec, and where $f_n$ is the frequency of the $n^{th}$ component in hertz, said gas velocity being in the range of Mach 0.7 to Mach 1, said nozzle having a discharge diameter 1.5 to 5 times greater than the diameter of said throat, said buffer reservoir being cylindrically shaped and having its longitudinal axis extending between said gas inlet and said throat,and said nozzle having one end positioned inside of said buffer reservoir and its opposite end positioned outside of said buffer reservoir.

11. The muffler of claim 1 including, said nozle having a nozzle inlet opening and a channel having a divergent portion with an included angle of between 3° and 8°, said nozzle having one end positioned inside of said buffer reservoir and its opposite end positioned outside of said buffer reservoir, said nozzle having a discharge diameter 1.5 to 5 times greater than the diameter of said throat, said buffer reservoir being cylindrically shaped and having its longitudinal axis extending between said gas inlet and said throat, and being adapted for use with said machinery generating low frequency noise below 20 hertz and unsteady inlet flow.

12. The muffler of claim 1 including, said nozzle having an inlet and an outlet, and a preswirling device connected to said nozzle inlet.

13. The muffler of claim 12 including, said preswirling device being a radial flow preswirler.

14. The muffler of claim 12 including, said preswirling device being an axial flow preswirler,

15. The muffler of claim 12 including, said preswirling device including three equally spaced apart fins.

16. The muffler of claim 12 including, said preswirling device including a core section having at least one conical end, a plurality of spaced fins secured to said core, and a cylinder surrounding said core and said fins.

17. The muffler of claim 1 including, said throat being dimensioned to obtain a gas flow speed in the throat of substantially Mach 1.

18. The muffler of claim 1 including, said nozzle having its discharge diameter being at least one and a half times the diameter of said throat.

19. The muffler of claim 18 including, said discharge diameter being about two and one half times said throat diameter.

20. The muffler of claim 1 including, said nozzle having its discharge diameter being at least one and a half times the diameter of said throat, said nozzle having an inlet and an outlet, a preswirling device connected to said inlet, and said preswirling device including a core secton having at least one conical end, a plurality of spaced fins secured to said core, and a cylinder surrounding said core and said fins.

21. The muffler of claim 1 including, said nozzle having a nozzle inlet opening and a channel having a divergent portion with an included angle of between 3° and 8°, said nozzle having its discharge diameter being at least one and a half times the diameter of said throat, said nozzle having an inlet and an outlet, a preswirling device connected to said inlet, and said preswirling device including a core section having at least one conical end, a plurality of spaced fins secured to said core,and a cylinder surrounding said core and said fins.

22. The muffler of claim 1 including, said displacement of the equivalent cylinder being equal to $a_n/\pi f_n$, where $a_n$ is the magnitude of the $n^{th}$ component of the unsteady flow in feet$^3$/sec, and where $f_n$ is the frequency of the $n^{th}$ component in hertz, said gas velocity being in the range of Mach 0.7 to Mach 1, said nozzle having a nozzle inlet opening and a channel having a divergent portion with an included angle of between 3° and 8°, said nozzle having one end positioned inside of said buffer reservoir and its opposite end positioned outside of said buffer reservoir, said nozzle having a discharge diameter 1.5 to 5 times greater than the diameter of said throat, said buffer reservoir being cylindrically shaped and having its longitudinal axis extending between said gas inlet and said throat, and being adapted for use with said machinery generating low frequency noise below 20 hertz and unsteady inlet flow, said nozzle having an inlet and an outlet, a preswirling device connected to said nozzle inlet, and said preswirling device including a core section having at least one conical end, a plurality of spaced fins secured to said core, and a cylinder surrounding said core and said fins.

23. For a piston compressor having a compressor inlet and at least one intake cylinder having an effective cylinder displacement, a muffler comprising:

a buffer reservoir having a reservoir inlet and a reservoir outlet, said reservoir outlet being communicable with said compressor inlet, said buffer reservoir having a volume ten to fifteen times said effective eylinder displacement, a convergent/divergent nozzle connected to said reservoir inlet, said nozzle including a throat through which the gas passes into said buffer reservoir, and said throat being dimensioned to obtain a gas flow velocity in the throat of at least Mach 0.7.

24. The muffler of claim 23 including, said gas flow velocity being in the range of Mach 0.7 to Mach 1.

25. The muffler of claim 24 including, said nozzle having a nozzle inlet, a channel having a divergent portion with an included angle of between 3° and 8°, said nozzle having a discharge diameter 1.5 to 5 times greater than the diameter of said throat, said buffer reservoir being cylindrically shaped and having its longitudinal axis extending between said gas inlet and said throat, a preswirling device connected to said nozzle inlet, and said preswirling device including a core section having at least one conical end, a plurality of spaced fins secured to said core, and a cylinder surrounding said core and said fins.

26. A system comprising:

gas inducting machinery having a determinable displacement of the largest equivalent cylinder and a gas inlet, a buffer reservoir having an inlet and an outlet, said outlet communicating with said gas inlet, said buffer reservoir having a volume of between twenty and thirty times the displacement of the largest equivalent cylinder of said gas inducting machinery, a convergent/divergent nozzle connected to said reservoir inlet, said nozzle including a throat through which the gas passes into said buffer reservoir, and said throat being dimensioned relative to said machinery to obtain a gas flow velocity in the throat of at least Mach 0.7.

27. The system of claim 26 including, said displacement of the equivalent cylinders being equal to $a_n/\pi f_n$, where $a_n$ is the magnitude of the $n^{th}$ component of the unsteady intake flow in feet$^3$/sec, and where $f_n$ is the frequency of the $n^{th}$ component in hertz.

28. The system of claim 26 including, said gas velocity being in the range of Mach 0.7 to Mach 1.

29. The system of claim 28 including, said nozzle having a nozzle inlet opening, and a channel having a divergent portion with an included angle of between 3° and 8°.

30. The system of claim 26 including, said buffer reservoir being adapted for use with sid machinery generating low frequency noise below 20 hertz and unsteady inlet flow.

31. The system of claim 26 including, said throat being dimensioned to obtain a gas flow speed in the throat of substantially Mach 1.

32. The system of claim 26 including, said displacement of the equivalent cylinder being equal to $a_n/\pi f_n$, where $a_n$ is the magnitude of the $n^{th}$ component of the unsteady flow in feet$^3$/sec, and where $f_n$ is the frequency of the $n^{th}$ component in hertz, said gas velocity being in the range of Mach 0.7 to Mach 1, said nozzle having a nozzle inlet opening and a channel having a divergent portion with an included angle of between 3° and 8°, and said buffer reservoir being adapted for use with said machinery generating low frequency noise below 20 hertz and unsteady inlet flow.

33. The system of claim 27 including, said gas velocity being in the range of Mach 0.7 to Mach 1, said nozzle having a nozzle inlet and a channel having a divergent portion with an included angle of between 3° and 8°, said nozzle having a discharge diameter 1.5 to 5 times greater than the diameter of said throat, said buffer reservoir being cylindrically shaped and having its longitudinal axis extending between said gas inlet and said throat, a preswirling device connected to said nozzle inlet, and said preswirling device including a core section having at least one conical end, a plurality of spaced fins secured to said core, and a cylinder surrounding said core and said fins.

34. The system of claim 27 including, said gas velocity being in the range of Mach 0.7 to Mach 1, said nozzle having a nozzle inlet and a channel having a divergent portion with an included angle of between 3° and 8°, said nozzle having one end positioned inside of said buffer reservoir and its opposite end positioned outside of said buffer reservoir, said nozzle having a discharge diameter 1.5 to 5 times greater than the diameter of said throat, said buffer reservoir being cylindrically shaped and having its longitudinal axis extending between said gas inlet and said throat, and being adapted for use with said machinery generating low frequency noise below 20 hertz and unsteady inlet flow, a preswirling device connected to said nozzle inlet, and said preswirling device including a core section having at least one conical end, a plurality of spaced fins secured to said core, and a cylinder surrounding said core and said fins.

35. The muffler of claim 4 including, said included angle being between 4½° and 5°.

* * * * *